US011846891B2

(12) United States Patent
Nukui et al.

(10) Patent No.: US 11,846,891 B2
(45) Date of Patent: Dec. 19, 2023

(54) FEEDING DEVICE AND IMAGE FORMING APPARATUS

(71) Applicant: FUJIFILM Business Innovation Corp., Tokyo (JP)

(72) Inventors: Tetsuo Nukui, Kanagawa (JP); Yuya Okawa, Kanagawa (JP); Chikara Kuno, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/398,006

(22) Filed: Aug. 10, 2021

(65) Prior Publication Data

US 2022/0269210 A1 Aug. 25, 2022

(30) Foreign Application Priority Data

Feb. 24, 2021 (JP) ..... 2021-027957

(51) Int. Cl.
*B65H 3/06* (2006.01)
*G03G 15/00* (2006.01)

(52) U.S. Cl.
CPC ..... *G03G 15/6529* (2013.01); *B65H 3/0661* (2013.01); *B65H 3/0669* (2013.01)

(58) Field of Classification Search
CPC ..... B65H 3/0669; B65H 3/0661; B65H 7/04; B65H 7/02; G03G 15/6529
See application file for complete search history.

(56) References Cited

U.S. PATENT DOCUMENTS 3,827,687 A * 8/1974 Kono ..... G03G 15/6502 271/157
2019/0098170 A1* 3/2019 Kodimer ..... H04N 1/38
2019/0193970 A1 6/2019 Yamaguchi

FOREIGN PATENT DOCUMENTS

JP 2019112197 7/2019

* cited by examiner

*Primary Examiner* — Thomas A Morrison
(74) *Attorney, Agent, or Firm* — JCIPRNET

(57) ABSTRACT

A feeding device includes a feeding device body of which a downstream end portion in a feeding direction, in which a material to be fed is fed, is mounted on a mounting portion, and that is openable and closable between a closed position where an upstream end portion is positioned above the downstream end portion and an open position where the upstream end portion is positioned on a side of the downstream end portion, a stacked portion that is provided on the feeding device body and on which the material to be fed is stacked in the open position, a detection unit that has a detection member hanging down to a downstream end portion of the stacked portion in the open position, moves to a downstream side in the feeding direction as the detection member is pressed by a downstream end portion of the material to be fed stacked on the stacked portion, and detects a stack of the materials to be fed on the stacked portion, and a restriction unit that restricts movement of the detection member to the downstream side in the feeding direction in the closed position.

8 Claims, 6 Drawing Sheets

FEEDING DEVICE AND IMAGE FORMING APPARATUS

CROSS-REFERENCE TO RELATED APPLICATIONS

This application is based on and claims priority under 35 USC 119 from Japanese Patent Application No. 2021-027957 filed Feb. 24, 2021.

BACKGROUND

(i) Technical Field

The present invention relates to a feeding device and an image forming apparatus.

(ii) Related Art

JP2019-112197A discloses a sheet transporting device that transports a sheet supported by a sheet supporting unit. The sheet transporting device includes an opening and closing member that is rotatable to a closed position and an opened position with respect to the sheet supporting unit, a flag member that is provided rotatably at the opening and closing member and is used for detecting the sheet on the sheet supporting unit, and an assisting member that is provided in the opening and closing member, is at a first position in a case where the opening and closing member is at the closed position and can be displaced to a second position from the first position due to the weight thereof in a case where the opening and closing member is at the opened position. In a case where the assisting member is positioned at the first position, the assisting member does not press the flag member, and in a case where the assisting member is positioned at the second position, the assisting member presses the flag member and biases the flag member to an opening and closing member side.

SUMMARY

As a feeding device, a feeding device including a feeding device body of which a downstream end portion in a feeding direction, in which a material to be fed, such as paper, is fed, is mounted on a mounting portion, and that is openable and closable between a closed position where an upstream end portion positioned above the downstream end portion and an open position where the upstream end portion is positioned on the side of the downstream end portion and a stacked portion that is provided in the feeding device body and on which the material to be fed is stacked in the open position is considered. As the feeding device, a feeding device further including a detection unit that has a detection member hanging down on a downstream end portion of the stacked portion in the open position, moves to a downstream side in the feeding direction as the detection member is pressed by a downstream end portion of the material to be fed stacked on the stacked portion, and detects a stack of the materials to be fed on the stacked portion is considered. In the feeding device, in a case where the detection member can move freely to the downstream side in the feeding direction in a state where the feeding device body is positioned at the closed position, the detection member moves to the downstream side in the feeding direction, and misdetection by the detection unit occurs in some cases when the feeding device body is moved from the open position to the closed position, regardless of the fact that the material to be fed is not pressed. The misdetection means detecting that the materials to be fed are stacked on the stacked portion regardless of the fact that the materials to be fed are not stacked on the stacked portion.

Aspects of non-limiting embodiments of the present disclosure relate to a feeding device and an image forming apparatus that prevent misdetection by the detection unit in the closed position of the feeding device body compared to a configuration where the detection member can move freely to the downstream side in the feeding direction in the closed position of the feeding device body.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a feeding device including a feeding device body of which a downstream end portion in a feeding direction, in which a material to be fed is fed, is mounted on a mounting portion, and that is openable and closable between a closed position where an upstream end portion is positioned above the downstream end portion and an open position where the upstream end portion is positioned on a side of the downstream end portion, a stacked portion that is provided on the feeding device body and on which the material to be fed is stacked in the open position, a detection unit that has a detection member hanging down to a downstream end portion of the stacked portion in the open position, moves to a downstream side in the feeding direction as the detection member is pressed by a downstream end portion of the material to be fed stacked on the stacked portion, and detects a stack of the materials to be fed on the stacked portion, and a restriction unit that restricts movement of the detection member to the downstream side in the feeding direction in the closed position.

BRIEF DESCRIPTION OF THE DRAWINGS

Exemplary embodiment(s) of the present invention will be described in detail based on the following figures, wherein.

DETAILED DESCRIPTION

Hereinafter, an example of an exemplary embodiment according to the present invention will be described based on the drawings.

Image Forming Apparatus 10

Figure 1:
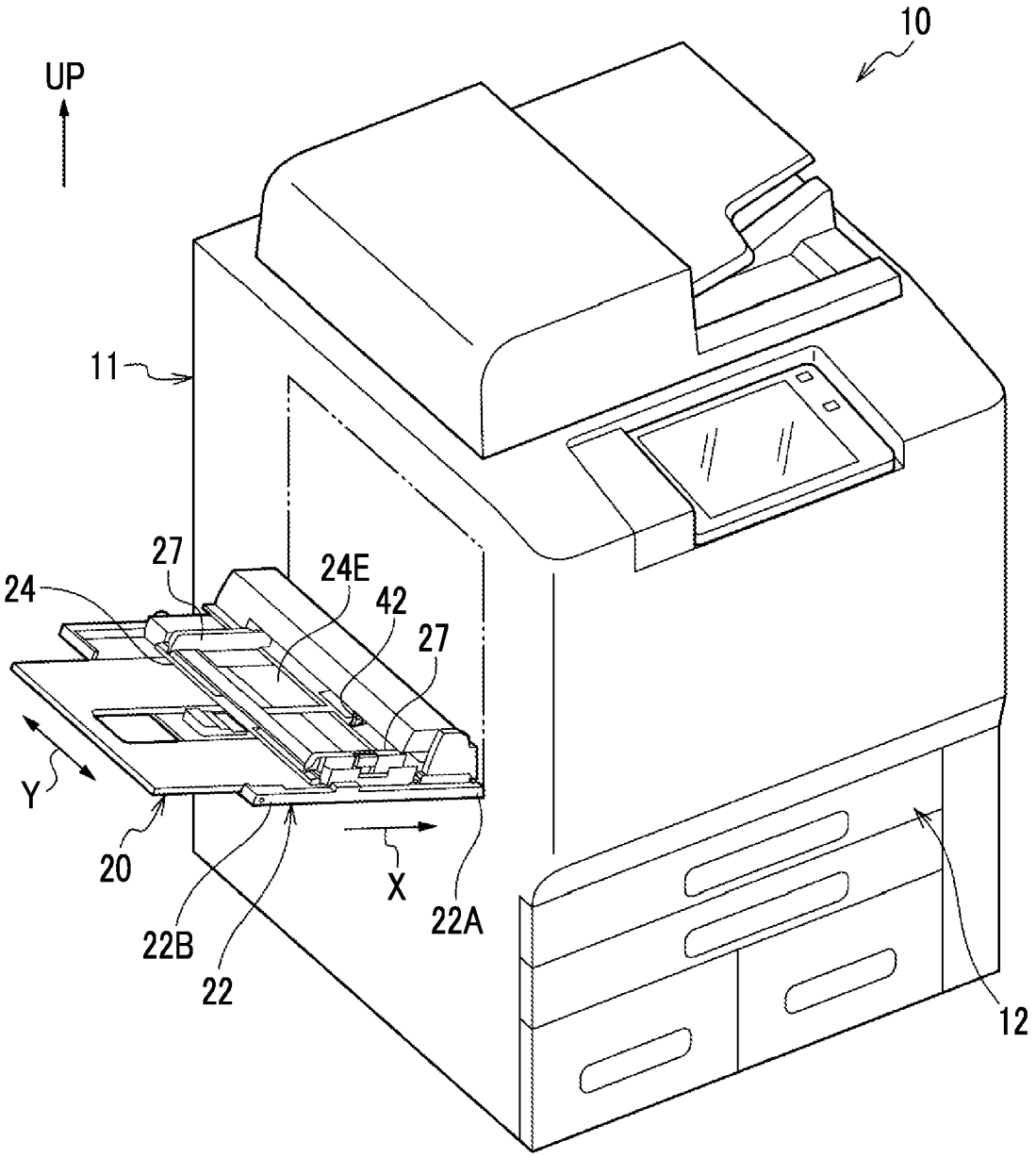
FIG. 1 is a perspective view illustrating an image forming apparatus according to the present exemplary embodiment.
Figure 2:
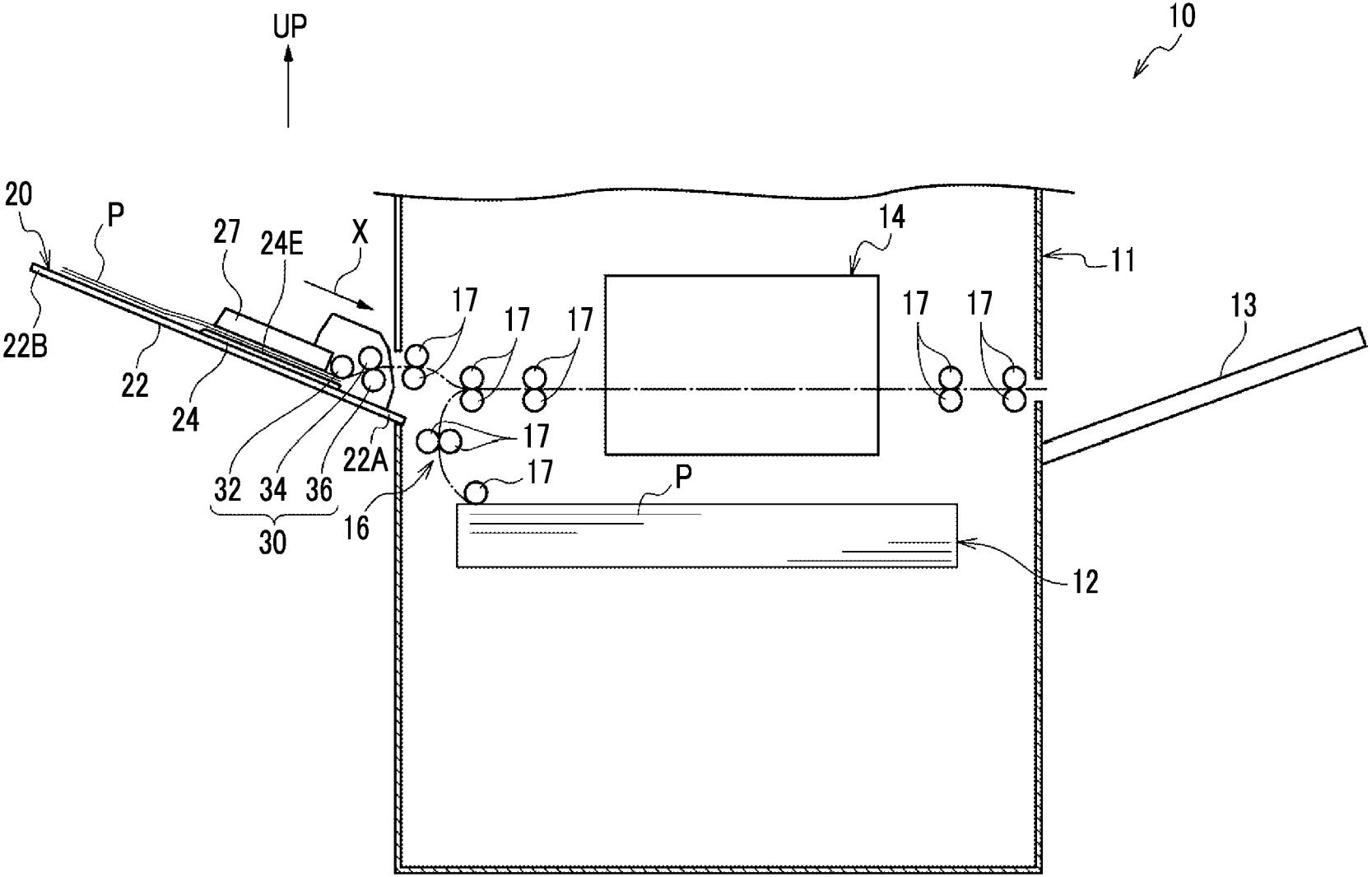
FIG. 2 is a regular cross-sectional view illustrating the image forming apparatus according to the present exemplary embodiment.

An image forming apparatus 10 according to the present exemplary embodiment will be described. FIG. 1 is a perspective view illustrating the image forming apparatus 10. FIG. 2 is a regular cross-sectional view illustrating the image forming apparatus 10. An arrow UP illustrated in each of the drawings including FIGS. 1 and 2 indicates an upper side (a vertically upper side) of the apparatus.

The image forming apparatus 10 illustrated in FIGS. 1 and 2 is an apparatus that forms an image. Specifically, as illustrated in FIGS. 1 and 2, the image forming apparatus 10 includes an image forming apparatus body 11, a medium accommodating unit 12, and a manual feeding tray 20. In addition, as illustrated in FIG. 2, the image forming apparatus 10 includes a medium discharged portion 13, an image forming unit 14, and a transporting mechanism 16. Hereinafter, each unit of the image forming apparatus 10 will be described.

Image Forming Apparatus Body 11

The image forming apparatus body 11 illustrated in FIGS. 1 and 2 is a portion where each configuration unit of the image forming apparatus 10 is provided. Specifically, as illustrated in FIG. 1, the image forming apparatus body 11 is configured by a housing formed in a substantially rectangular parallelepiped shape.

As illustrated in FIG. 2, in the present exemplary embodiment, for example, the medium accommodating unit 12, the image forming unit 14, and the transporting mechanism 16 are provided inside the image forming apparatus body 11. The manual feeding tray 20 is openably and closably mounted on one side surface of the image forming apparatus body 11. The medium discharged portion 13 is provided on the other side surface of the image forming apparatus body 11. The image forming apparatus body 11 is an example of a "mounting portion".

Medium Accommodating Unit 12

As illustrated in FIG. 2, the medium accommodating unit of the image forming apparatus 10 is a portion that accommodates a recording medium P. The recording medium P accommodated in the medium accommodating unit 12 is supplied to the image forming unit 14. As the recording medium P, for example, paper P is used.

Medium Discharged Portion 13

The medium discharged portion 13 of the image forming apparatus 10, which is illustrated in FIG. 2, is a portion to which the recording medium P is discharged. The recording medium P on which an image is formed by the image forming unit 14 is discharged to the medium discharged portion 13.

Image Forming Unit 14

The image forming unit 14 illustrated in FIG. 2 has a function of forming an image on the recording medium P fed from the medium accommodating unit 12 and the manual feeding tray 20. Examples of the image forming unit 14 include an inkjet image forming unit that forms an image on the recording medium P using inks and an electrophotographic image forming unit that forms an image on the recording medium P using toners.

In the inkjet image forming unit, for example, ink droplets are jetted to the recording medium P from a jetting unit, and forms an image on the recording medium P. The inkjet image forming unit may form an image on the recording medium P as the jetting unit jets ink droplets to a transfer body and the ink droplets are transferred from the transfer body to the recording medium P.

The electrophotographic image forming unit performs, for example, each of processes such as charging, exposing, developing, transferring, and fixing, and forms an image on the recording medium P. After the image is formed on the transfer body by performing each of the processes, such as charging, exposing, developing, and transferring, and the image is transferred from the transfer body to the recording medium P, the electrophotographic image forming unit may form the image on the recording medium P by fixing the image to the recording medium P.

Examples of the image forming unit are not limited to the inkjet image forming unit described above and the electrophotographic image forming unit described above, and various image forming units can be used.

Transporting Mechanism 16

The transporting mechanism 16 illustrated in FIG. 2 is a mechanism that transports the recording medium P. The transporting mechanism 16 transports the recording medium P, for example, with a transporting member 17 such as a transporting roller. The transporting member 17 may be a transporting belt, and may be any member that applies a transporting force to the recording medium P and can transport the recording medium P.

The transporting mechanism 16 transports the recording medium P from the medium accommodating unit 12 to the image forming unit 14. In addition, the transporting mechanism 16 transports the recording medium P fed from the manual feeding tray 20 to the image forming unit 14. Further, the transporting mechanism 16 transports the recording medium P from the image forming unit 14 to the medium discharged portion 13.

Manual Feeding Tray 20

Figure 3:
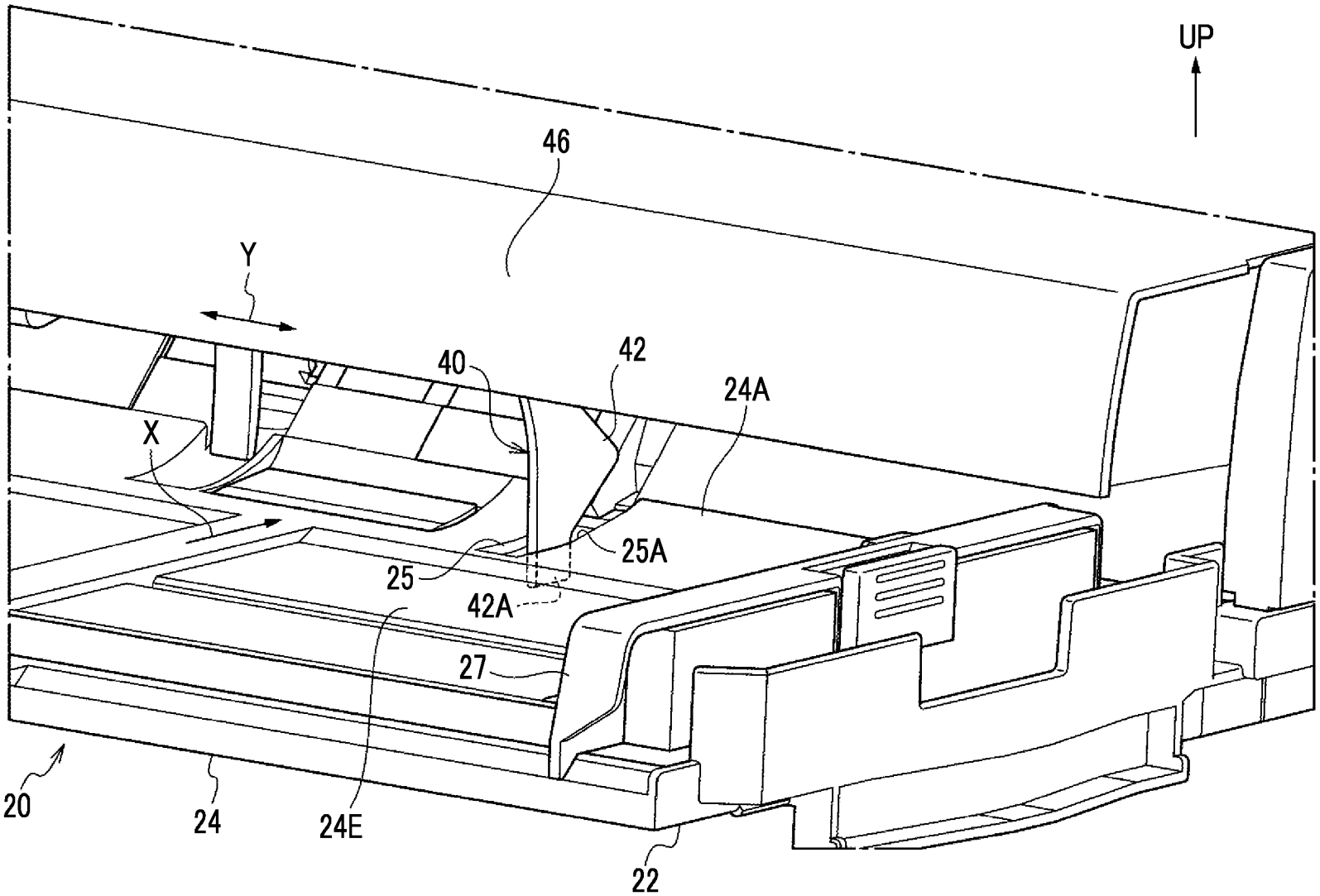
FIG. 3 is an enlarged perspective view illustrating a part of a manual feeding tray according to the present exemplary embodiment.
Figure 4:
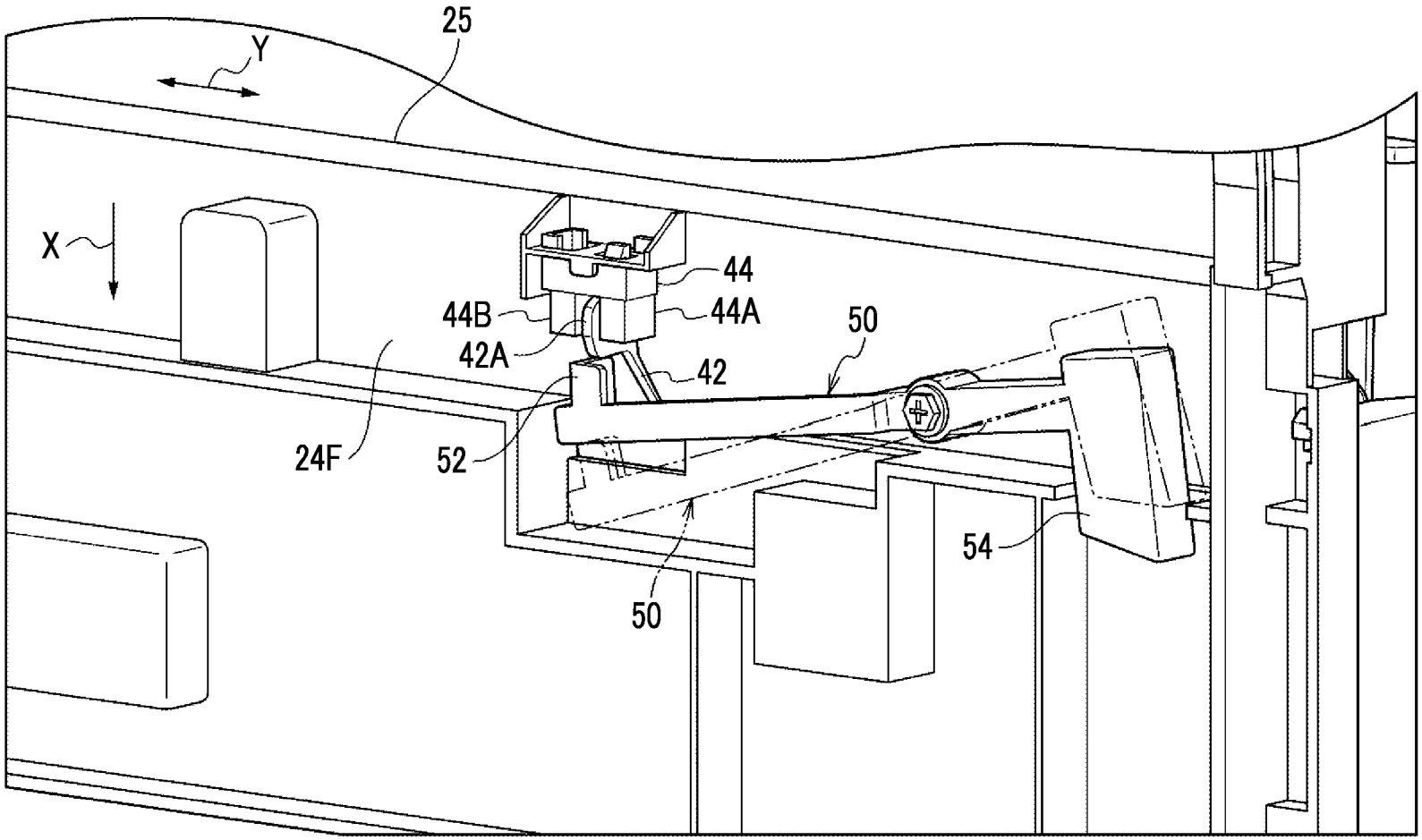
FIG. 4 is a perspective view illustrating a detection unit and a restriction unit, which are provided on the manual feeding tray according to the present exemplary embodiment.
Figure 5:
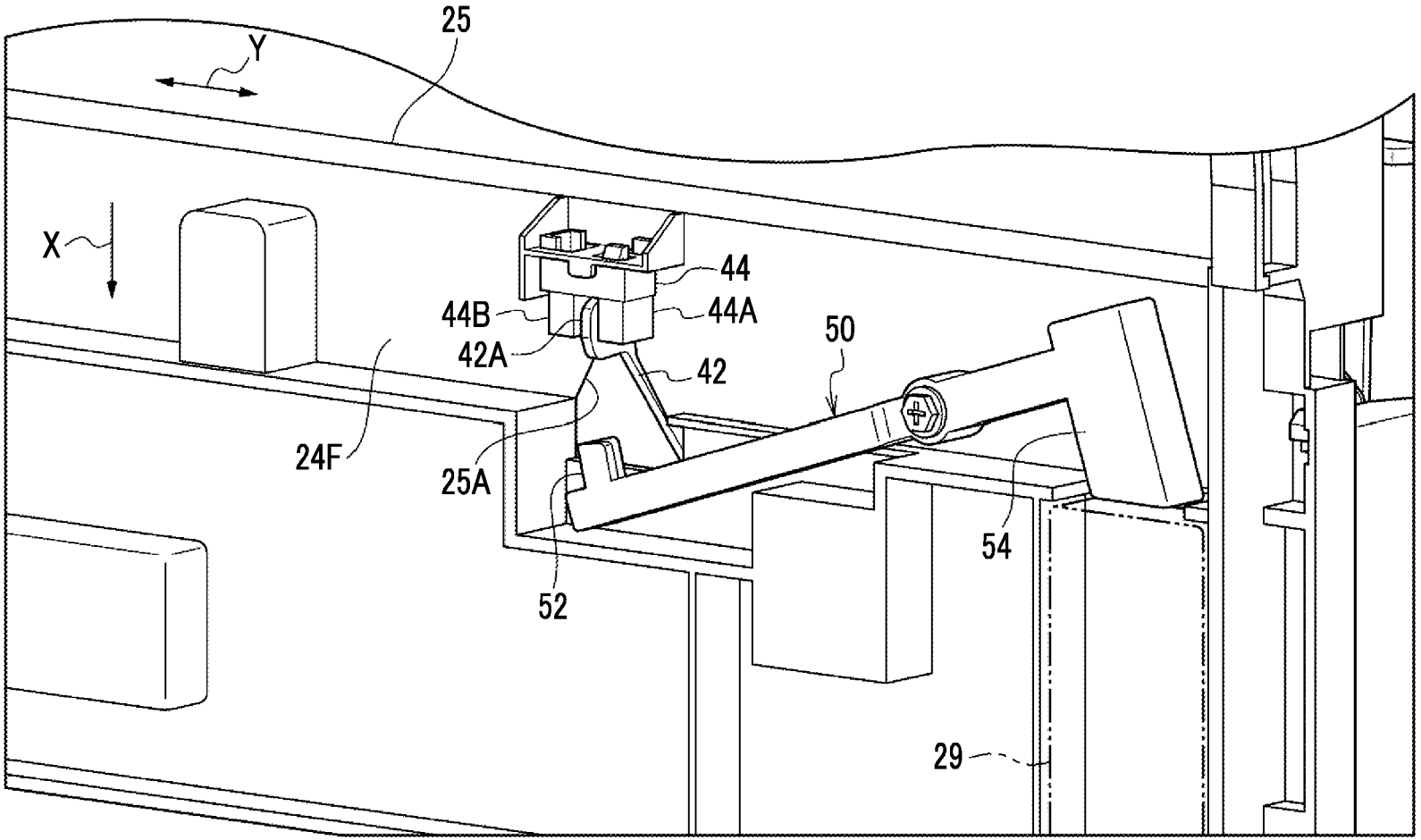
FIG. 5 is a perspective view illustrating a state where a detection member is positioned at a retracted position, in the configuration illustrated in FIG. 4.
Figure 6:
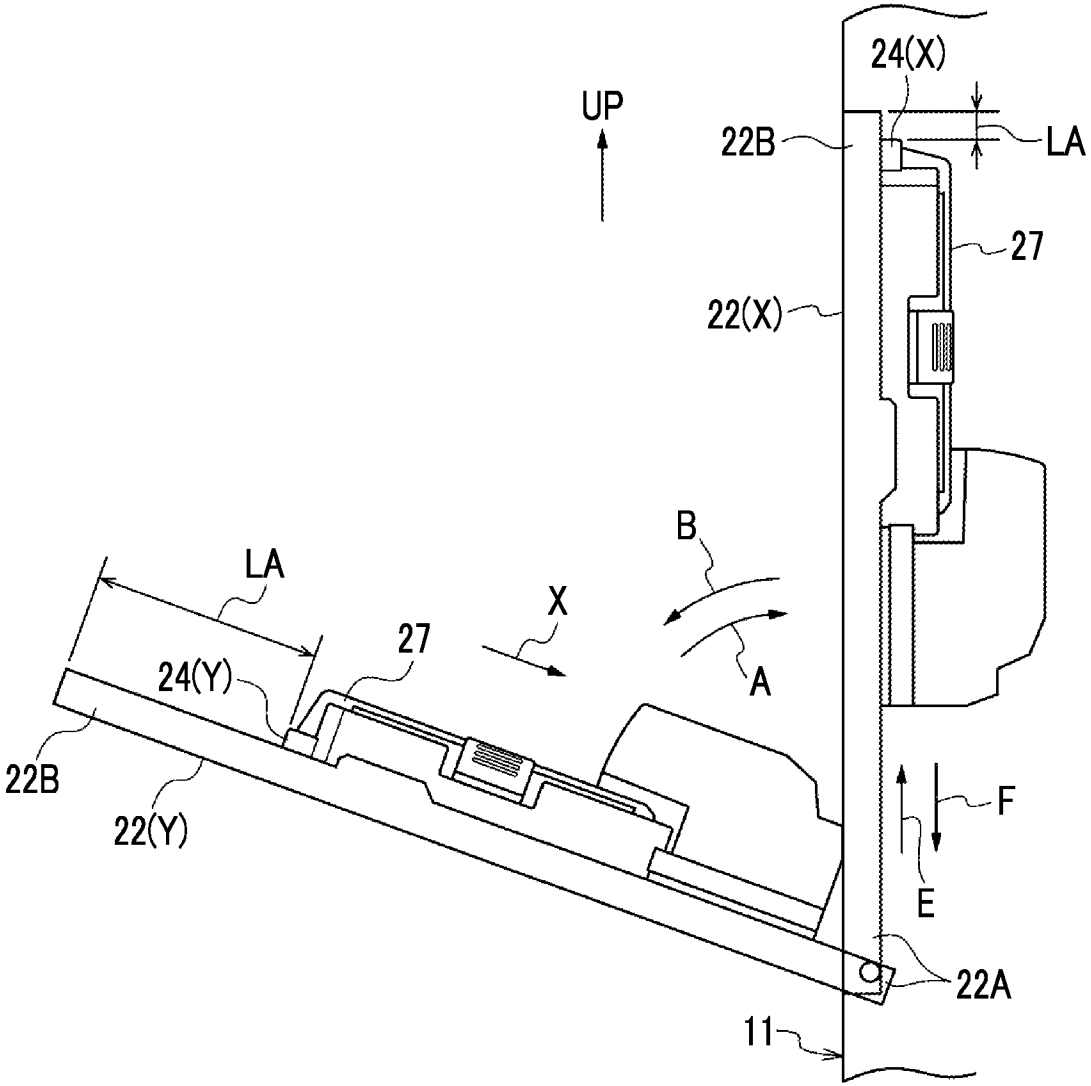
FIG. 6 is a side view illustrating an opening and closing operation of the manual feeding tray with respect to the image forming apparatus body according to the present exemplary embodiment.

FIG. 3 is an enlarged perspective view of a part of the manual feeding tray 20. FIGS. 4 and 5 are perspective views illustrating a detection unit 40 and a restriction unit 50, which are provided on the manual feeding tray 20 and are to be described later. FIG. 6 is a side view illustrating an opening and closing operation of the manual feeding tray 20 with respect to the image forming apparatus body 11.

As illustrated in FIG. 2, the manual feeding tray 20 of the image forming apparatus 10 is a portion on which the recording media Pare stacked. The tray means a member on which the recording media P are stacked. Manual feeding means an operation of manually stacking the recording media P by a user of the image forming apparatus 10. Therefore, the manual feeding tray 20 means a member on which the recording media P are manually stacked by the user of the image forming apparatus 10.

In addition, as described above, the manual feeding tray 20 is provided outside the image forming apparatus body 11. On the manual feeding tray 20, the recording media P are stacked in a state of being exposed to the outside of the image forming apparatus body 11.

Further, the manual feeding tray 20 functions as, for example, a feeding device that feeds the recording medium P of a type which cannot be fed from the medium accommodating unit 12 or which is not appropriate for being fed from the medium accommodating unit 12. The type includes cardboard, postcards, envelopes, non-standard size paper, and resin films.

Specifically, as illustrated in FIG. 2, the manual feeding tray 20 includes a tray body 22, a stacked portion 24, and a feeding mechanism 30. Further, the manual feeding tray 20 includes the detection unit 40 (see FIGS. 3 to 5) and the restriction unit 50 (see FIGS. 4 and 5).

The manual feeding tray 20 is an example of a "feeding device". The recording medium P is an example of a "material to be fed".

Tray Body 22

As illustrated in FIGS. 1 and 2, the tray body 22 is a portion where each configuration unit of the manual feeding tray 20 is provided. As illustrated in FIGS. 1, 2, and 6, a downstream end portion 22A of the tray body 22 in a feeding direction (an arrow X direction in the drawings), in which the recording medium P is fed, is mounted on the image forming apparatus body 11. In the present exemplary embodiment, as illustrated in FIG. 6, an upstream end portion 22B of the tray body 22 is movable in a closing direction (an arrow A direction in FIG. 6) and an opening direction (an arrow B direction in FIG. 6) with the downstream end portion 22A as a fulcrum (that is, a rotation center).

That is, the tray body 22 is openable and closable between a closed position (a position indicated by a reference sign 22(X) in FIG. 6) where the upstream end portion 22B in the feeding direction is positioned above the downstream end portion 22A and an open position (a position indicated by a reference sign 22(Y) in FIG. 6 and a position illustrated in FIG. 3) where the upstream end portion 22B is positioned on the side of the downstream end portion 22A. A state where the upstream end portion 22B is positioned on the side of the downstream end portion 22A is a state where the upstream end portion 22B is positioned at a position other than positions vertically above and vertically below the downstream end portion 22A. In addition, at the open position, the upstream end portion 22B may be arranged at a position lower than the position thereof in the closed position. The tray body 22 is an example of a "feeding device body".

Stacked Portion 24

The stacked portion 24 is a portion on which the recording media P are stacked. As illustrated in FIGS. 1, 2, and 6, the stacked portion 24 is provided on an inner side (a closing direction (the arrow A direction in FIG. 6) side of the tray body 22) of the tray body 22 movably along the tray body 22. Specifically, the stacked portion 24 is movable in a separating direction (an arrow E direction in FIG. 6) in which the stacked portion separates from the downstream end portion 22A (that is, the rotation center) of the tray body 22 to the upstream end portion 22B (that is, a free end) and an approaching direction (an arrow F direction in FIG. 6), which is an opposite direction thereof.

In the present exemplary embodiment, a link mechanism (not illustrated) moves the stacked portion 24 in the separating direction and the approaching direction in a movement range determined in advance with the opening and closing operation of the tray body 22. Specifically, the stacked portion 24 is positioned at a separated position (a position indicated by a reference sign 24(X) in FIG. 6) in a state where the tray body 22 is positioned at the closed position (hereinafter, referred to as "in the closed position of the tray body 22"), and moves from the separated position to an approached position (a position indicated by a reference sign 24(Y) in FIG. 6) in a case where the tray body 22 is rotated from the closed position to the open position. In the present exemplary embodiment, since the fulcrum (that is, the rotation center) of the tray body 22 and a fulcrum (that is, a rotation center) of the stacked portion 24 are at position different from each other in the link mechanism (not illustrated), the stacked portion 24 moves relatively to the tray body 22 as described above with the rotation of the tray body 22 and the stacked portion 24. A distance LA between an upstream end of the stacked portion 24 and an upstream end of the tray body 22 is longer in a case where the stacked portion 24 is positioned at the separated position than in a case where the stacked portion is positioned at the approached position.

The stacked portion 24 is formed in a plate shape (flat shape) of which a thickness direction is the opening direction (the arrow B direction in FIG. 6) of the tray body 22. As illustrated in FIGS. 1 and 2, in a state where the tray body 22 is positioned at the open position (hereinafter, referred to as "in the open position of the tray body 22"), a stacked surface 24E of the stacked portion 24, on which the recording media P are stacked, is exposed. Therefore, the recording media P are stacked on the stacked portion 24 in a state of being exposed to the outside of the image forming apparatus body 11.

As illustrated in FIG. 3, a slit 25A (that is, a hole) where a detection member 42 of the detection unit 40, which is to be described later, is arranged is formed in a wall portion 25 having the stacked surface 24E. The slit 25A extends along the feeding direction.

Depending on the size of the recording medium P, there are a case where the entire recording medium P is stacked on the stacked portion 24 and a case where a part of the recording medium P is stacked on the stacked portion 24 and the other part is stacked on the tray body 22.

In addition, side guides 27 that come into contact with both side end portions of the recording media P stacked on the stacked portion 24, respectively, are provided on the stacked portion 24 (see FIG. 1). The side guides 27 are movable in an intersecting direction with respect to the feeding direction.

Feeding Mechanism 30

The feeding mechanism 30 illustrated in FIG. 2 is a mechanism that feeds the recording medium P from the stacked portion 24. Specifically, the feeding mechanism 30 transports the recording medium P, which is fed from the stacked portion 24, to the image forming apparatus body 11. Therefore, the feeding mechanism 30 can also be called a supply mechanism that supplies the recording medium P to the image forming apparatus body 11. Specifically, the feeding mechanism 30 has a feeding roller 32, a transporting roller 34, and an applying roller 36.

By rotating while coming into contact with a portion of the front surface of the recording medium P positioned uppermost, which is on a downstream side in the feeding direction, among the recording media P stacked on the stacked portion 24, the feeding roller 32 feeds the recording medium P from the stacked portion 24. The feeding roller 32 is a roller which is also called a pickup roller or a nudger roller.

The transporting roller 34 is arranged on the downstream side in the feeding direction with respect to the feeding roller 32. The applying roller 36 is arranged below the transporting roller 34, and is in contact with the transporting roller 34. The transporting roller 34 further transports the recording medium P fed by the feeding roller 32 to the downstream side in the feeding direction. The transporting roller 34 is a roller which is also called a feed roller.

The applying roller 36 is a roller that is driven to rotate in a case where a rotational force determined in advance is applied, and functions as a brake that generates a rotational load until the rotational force determined in advance is applied. In a case where a plurality of recording media P overlap each other and are introduced between the transporting roller 34 and the applying roller 36, the applying roller 36 applies a transporting resistance from the back surface side of the recording medium P as the applying roller 36 functions as the brake as described above, preventing double feeding of the recording media P transported by the transporting roller 34. The applying roller 36 is a roller which is also called a retard roller.

In a case where the feeding mechanism 30 feeds the plurality of recording media P, which are overlapping each other, from the stacked portion 24 as described above, the transporting roller 34 applies a transporting force to the upper recording medium P (that is, the first recording medium P), while the applying roller 36 applies a transporting resistance to the lower recording medium P (the second and subsequent recording media P). That is, the sheets of paper P overlapping each other are separated (detached) by the transporting roller 34 and the applying roller 36, and the feeding mechanism 30 feeds the recording media P one by one.

Detection Unit 40

The detection unit 40 illustrated in FIGS. 3 to 5 has a function of detecting a stack of recording media P on the stacked portion 24. As illustrated in FIGS. 4 and 5, the detection unit 40 has the detection member 42 and a sensor 44.

In the open position (a position illustrated in FIG. 3) of the tray body 22, the detection member 42 hangs down to a downstream end portion 24A of the stacked portion 24. Specifically, the detection member 42 is supported oscillatably along the feeding direction by a support body 46 arranged above the downstream end portion 24A of the stacked portion 24, in the open position of the tray body 22. Specifically, the detection member 42 is oscillatable between an arrangement position (a position illustrated in FIGS. 3 to 5) where a downstream end portion of the recording medium P stacked on the stacked portion 24 is arranged and a downstream position on the downstream side in the feeding direction with respect to the arrangement position. In the open position (the position illustrated in FIG. 3) of the tray body 22, the detection member 42 is positioned at the arrangement position due to the weight thereof.

The detection member 42 is formed in a plate shape of which a thickness direction is the intersecting direction with respect to the feeding direction (specifically, an orthogonal direction and an arrow Y direction in the drawing), and in side view, a substantially triangular shape having an apex on the downstream side in the feeding direction. Further, the detection member 42 has a protruding portion 42A that protrudes downward. The side view means a case of viewing in the intersecting direction with respect to the feeding direction (specifically, the orthogonal direction).

The protruding portion 42A of the detection member 42 is arranged in the slit 25A of the stacked portion 24, which is described above, and the detection member 42 oscillates in the feeding direction along the slit 25A.

As illustrated in FIGS. 4 and 5, the sensor 44 is provided on an opposite surface 24F of the stacked portion 24 with respect to the stacked surface 24E of the wall portion 25. The sensor 44 is an optical sensor using light with which the detection member 42 positioned at the arrangement position is irradiated. Specifically, the sensor 44 is a transmissive optical sensor that has a light emitting unit 44A and a light receiving unit 44B.

As light with which the light receiving unit 44B is irradiated from the light emitting unit 44A is blocked by the detection member 42 positioned at the arrangement position, the sensor 44 detects that the detection member 42 is positioned at the arrangement position. In a case where the detection member 42 is positioned at the downstream position, the light receiving unit 44B receives the light with which the light receiving unit 44B is irradiated from the light emitting unit 44A, the sensor detects that the detection member 42 is positioned at a retracted position.

Then, as the detection member 42 is pressed by the downstream end portions of the recording medium P stacked on the stacked portion 24 and moves to the downstream side in the feeding direction, the detection unit 40 detects a stack of the recording media P on the stacked portion 24.

Herein, in a case where the tray body 22 is positioned at the closed position, the recording media P cannot be stacked on the stacked portion 24. Thus, it is possible to detect that the recording media P are not stacked on the stacked portion 24 by detecting that the tray body 22 is positioned at the closed position. On the contrary, in the present exemplary embodiment, a detection unit detecting that the tray body 22 is positioned at the closed position is not provided in the image forming apparatus body 11. For this reason, it is impossible to detect that the recording media P are not stacked on the stacked portion 24 based on the position of the tray body 22. Therefore, even in a case where the tray body 22 is positioned at the closed position, misdetection by the detection unit 40 can occur. The misdetection means detecting that the recording media P are stacked on the stacked portion 24 regardless of the fact that the recording media P are not stacked on the stacked portion 24.

Restriction Unit 50 and Moving Member 29

As illustrated in FIG. 4, in the closed position of the tray body 22, the restriction unit 50 has a function of restricting the movement of the detection member 42 to the downstream side in the feeding direction.

The restriction unit 50 is arranged on the opposite surface 24F of the wall portion 25 of the stacked portion 24, and is oscillatably supported by the wall portion 25. The restriction unit 50 is oscillatable between a restricted position (a position indicated by a solid line in FIG. 4) where the restriction unit is in contact with the detection member 42 positioned at the arrangement position and restricts the movement of the detection member 42 to the downstream side in the feeding direction and the retracted position (a position indicated by a two-dot chain line in FIG. 4, and a position indicated by a solid line in FIG. 5) retracted from the restricted position.

The restriction unit 50 is formed in a rod shape which is long in an intersecting direction with respect to a transporting direction. On one end portion (a left end portion in FIGS. 4 and 5) of the restriction unit 50 in a longitudinal direction, a contact portion 52 that protrudes to an upstream side (an upper side in FIGS. 4 and 5) in the feeding direction is provided. In a state where the restriction unit 50 is positioned at the contact position, the contact portion 52 is in contact with the detection member 42 from the downstream side in the feeding direction with respect to the detection member 42, and restricts the movement of the detection member 42 to the downstream side in the feeding direction. In other words, the contact portion 52 supports the detection member 42 in a state where the restriction unit 50 is positioned at the contact position. Therefore, the restricted position of the restriction unit 50 is also called a supporting position where the detection member 42 is supported.

On the other hand, on the other end portion (a right end portion in FIGS. 4 and 5) of the restriction unit 50 in the longitudinal direction, a weight portion 54 is provided. The weight portion 54 protrudes to the downstream side in the feeding direction (a lower side in FIGS. 4 and 5). An intermediate portion (a portion between the contact portion 52 and the weight portion 54) of the restriction unit 50 in the longitudinal direction is oscillatably mounted on the wall portion 25.

In the closed position of the tray body 22, the restriction unit 50 is in a posture in which a protruding direction of the weight portion 54 faces downward. Therefore, with the movement from the open position to the closed position of the tray body 22, the restriction unit 50 moves from the retracted position to the restricted position due to the weight of the weight portion 54.

The moving member 29 illustrated in FIG. 5 is arranged on the tray body 22 that moves relatively to the stacked portion 24 as described above. Therefore, the moving member 29 moves relatively to the restriction unit 50 arranged on the stacked portion 24 with movement from the closed position to the open position of the tray body 22. More specifically, as the rotation fulcrums of the tray body 22 and the stacked portion 24 are different from each other depending on cases of moving to the open position and the closed position, a relative position between the moving member 29 and the weight portion 54 is different depending on the open position and the closed position of the tray body 22. In the open position of the tray body 22, the moving member 29 and the weight portion 54 approach each other. In the closed position of the tray body 22, the moving member 29 and the weight portion 54 separate from each other.

Then, in a case where the tray body 22 moves from the closed position to the open position, the moving member 29 presses the weight portion 54 to the upstream side in the feeding direction. Accordingly, the restriction unit 50 moves from the restricted position to the retracted position. As described above, the restriction unit 50 is pressed by the moving member 29, which is moving relatively to the restriction unit 50 with the movement from the closed position to the open position of the tray body 22, and moves from the restricted position to the retracted position (see FIG. 5). Therefore, in the open position of the tray body 22, the restriction unit 50 is positioned at the retracted position. The retracted position is a position where the restriction unit 50 does not support the detection member 42, and is a position retracted from a movement trajectory of the detection member 42.

Since the restriction unit 50 is not in contact with the detection member 42 in the closed position of the tray body 22, a movement resistance to the downstream side in the feeding direction is not applied to the detection member 42. In other words, a state where the movement resistance is not applied to the detection member 42 is, in the closed position of the tray body 22, a state where the restriction unit 50 is not in contact with the detection member 42, and is not in contact with the detection member 42 also in a case where the detection member 42 moves to the downstream side in the feeding direction.

Workings According to Present Exemplary Embodiment

In the configuration of the present exemplary embodiment, as illustrated in FIG. 4, in the closed position of the tray body 22, the restriction unit 50 has a function of restricting the movement of the detection member 42 to the downstream side in the feeding direction.

For this reason, compared to a configuration where the detection member 42 is capable of moving freely to the downstream side in the feeding direction in the closed position of the tray body 22, misdetection by the detection unit 40 in the closed position of the tray body 22 is prevented.

Herein, in the present exemplary embodiment, a detection unit that detects that the tray body 22 is positioned at the closed position is not provided in the image forming apparatus body 11 as described above. Therefore, with the configuration of the present exemplary embodiment, even though it is impossible to detect that the tray body 22 is positioned at the closed position, preventing misdetection by the detection unit in the closed position of the tray body 22 is possible.

In addition, in the present exemplary embodiment, since the restriction unit 50 is not in contact with the detection member 42 in the closed position of the tray body 22, a movement resistance to the downstream side in the feeding direction is not applied to the detection member 42.

For this reason, in the open position of the tray body 22, the restriction unit 50 prevents the detection member 42 from becoming a resistance to the feeding of the recording medium P, compared to a configuration where a movement resistance to the downstream side in the feeding direction is applied to the detection member 42. As a configuration of applying the movement resistance, a configuration of applying a force toward the upstream side in the feeding direction to the detection member 42 with the elastic force of an elastic member, such as a spring, is considered.

In addition, in the present exemplary embodiment, the restriction unit 50 is positioned at the retracted position in the open position of the tray body 22. For this reason, compared to a configuration where the restriction unit 50 is positioned at the retracted position at all times, it is possible to prevent the detection member 42 from becoming a resistance to the feeding of the recording medium P.

In addition, in the present exemplary embodiment, with the movement from the open position to the closed position of the tray body 22, the restriction unit 50 moves from the retracted position to the restricted position due to the weight of the weight portion 54. For this reason, a drive force for moving the restriction unit 50 to the restricted position is unnecessary.

In addition, in the present exemplary embodiment, the restriction unit 50 is pressed by the moving member 29 which is moving relatively to the restriction unit 50 with movement from the closed position to the open position of the tray body 22, and moves from the restricted position to the retracted position (see FIG. 5). For this reason, the restriction unit is able to be moved to the retracted position through an operation of moving the feeding device body from the closed position to the open position. In addition, since the restriction unit 50 is pressed by the moving member 29 that is interlocked with the movement of the tray body 22 from the closed position to the open position, a drive force for moving the restriction unit 50 to the retracted position is unnecessary.

Modification Example

Although the restriction unit 50 does not apply a movement resistance to the downstream side in the feeding direction to the detection member 42 in the closed position of the tray body 22 in the present exemplary embodiment, the invention is not limited thereto. For example, as the restriction unit 50 comes into contact with the detection member 42 in the open position of the tray body 22, a configuration where the movement resistance to the downstream side in the feeding direction is applied to the detection member 42 may be adopted. As a configuration of applying the movement resistance, a configuration of applying a force toward the upstream side in the feeding direction to the detection member 42 with the elastic force of the elastic member, such as a spring, is considered as described above.

In addition, although the restriction unit 50 is positioned at the retracted position in the open position of the tray body 22 in the present exemplary embodiment, the invention is not limited thereto. For example, the restriction unit 50 may be configured to be positioned at the retracted position at all times.

In addition, although the restriction unit 50 moves from the retracted position to the restricted position due to the weight of the weight portion 54 with the movement from the open position to the closed position of the tray body 22 in the present exemplary embodiment, the invention is not limited thereto. For example, the restriction unit 50 may be configured to move from the retracted position to the restricted position by a drive force (for example, a drive force generated by an actuator such as a cylinder) of moving the restriction unit 50 to the restricted position.

In addition, although the restriction unit 50 is pressed by the moving member 29 and moves from the restricted position to the retracted position in the present exemplary embodiment, the invention is not limited thereto. For example, the restriction unit 50 may be configured to move from the restricted position to the retracted position by a drive force (for example, a drive force generated by an actuator such as a cylinder) of moving the restriction unit 50 to the retracted position.

In addition, although the restriction unit 50 oscillates in the present exemplary embodiment, the invention is not limited thereto. For example, the restriction unit 50 may move through linear motion, or may be configured to move.

Although the paper P is used as the recording medium P, which is an example of the material to be fed, the invention is not limited thereto. For example, as an example of the recording medium P, for example, a resin film and a metal film may be used, or any recording medium that can be fed may be used. In addition, although the recording medium P on which an image is formed is used as an example of the material to be fed in the present exemplary embodiment, the invention is not limited thereto. For example, as an example of the material to be fed, a material to be fed, which is fed for the purpose of inspection and other processes instead of the purpose of performing a process of forming an image, or a material to be fed, which is fed for the exclusive purpose of transporting, may be used.

Although the image forming apparatus body 11 is used as an example of the mounting portion in the present exemplary embodiment, the invention is not limited thereto. As an example of the mounting portion, for example, a device that reads an image, which is a transported material fed from the manual feeding tray 20, may be used, or a device on which the manual feeding tray 20 is mounted may be used.

Although the manual feeding tray 20 is used as an example of the feeding device in the present exemplary embodiment, without being limited thereto, various feeding devices are applicable.

The present invention is not limited to the exemplary embodiment, and various modifications, changes, and improvements can be made without departing from the gist thereof. For example, the plurality of modification examples described above may be configured in combination as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding device comprising:

a feeding device body of which a downstream end portion in a feeding direction, in which a material to be fed is fed, is mounted on a mounting portion, and that is openable and closable between a closed position where an upstream end portion is positioned above the downstream end portion and an open position where the upstream end portion is positioned on a side of the downstream end portion;

a stacked portion that is provided on the feeding device body and on which the material to be fed is stacked in the open position;

a detection unit that has a detection member hanging down to a downstream end portion of the stacked portion in the open position, moves to a downstream side in the feeding direction as the detection member is pressed by a downstream end portion of the material to be fed stacked on the stacked portion in the open position, and detects a stack of the materials to be fed on the stacked portion; and a restriction unit that restricts movement of the detection member to the downstream side in the feeding direction in the closed position, wherein the restriction unit includes a contact portion configured to be in contact with the detection member, a weight portion and an intermediate portion between the contact portion and the weight portion, and the intermediate portion is pivotally mounted on the stacked portion.

2. The feeding device according to claim 1, wherein in the open position, the restriction unit does not apply a movement resistance to the downstream side in the feeding direction to the detection member.

3. The feeding device according to claim 1, wherein in the closed position, the restriction unit restricts the movement as the detection member is supported at a supporting position for the detection member, which is on the downstream side in the feeding direction, and in the open position, the restriction unit is positioned at a retracted position retracted from the supporting position.

4. The feeding device according to claim 3, wherein the restriction unit moves from the retracted position to the supporting position due to a weight of the restriction unit with movement of the feeding device body from the open position to the closed position.

5. The feeding device according to claim 3, further comprising:

a moving member that moves relatively to the restriction unit with movement of the feeding device body from the closed position to the open position, wherein the restriction unit is pressed by the moving member that moves relatively to the restriction unit with the movement of the feeding device body, and moves from the supporting position to the retracted position.

6. The feeding device according to claim 4, further comprising:

a moving member that moves relatively to the restriction unit with movement of the feeding device body from the closed position to the open position, wherein the restriction unit is pressed by the moving member that moves relatively to the restriction unit with the movement of the feeding device body, and moves from the supporting position to the retracted position.

7. An image forming apparatus comprising:

the feeding device according to claim 1, of which the feeding device body is mounted on an image forming apparatus body that is the mounting portion; and an image forming unit that is provided in the image forming apparatus body and forms an image on a recording medium as a material to be fed, which is fed from the feeding device.

8. The image forming apparatus according to claim 7, wherein a detection unit that detects that the feeding device body is positioned at the closed position is not provided in the image forming apparatus body.

* * * * *